US010842272B2

(12) United States Patent
Costaglia

(10) Patent No.: US 10,842,272 B2
(45) Date of Patent: Nov. 24, 2020

(54) OFFICE CHAIR WITH SYNCHRONOUSLY MOVABLE BACKREST AND SEAT

(71) Applicant: REXSITT ITALIA S.R.L., Bertinoro (IT)

(72) Inventor: Massimo Costaglia, Santa Giustina In Colle (IT)

(73) Assignee: REXSITT ITALIA S.R.L., Bertinoro (IT)

( * ) Notice: Subject to any disclaimer, the term of this patent is extended or adjusted under 35 U.S.C. 154(b) by 0 days.

(21) Appl. No.: 16/291,410

(22) Filed: Mar. 4, 2019

(65) Prior Publication Data

US 2019/0380497 A1 Dec. 19, 2019

(30) Foreign Application Priority Data

Jun. 14, 2018 (IT) ..... 202018000002761

(51) Int. Cl.
*A47C 1/024* (2006.01)
*A47C 3/026* (2006.01)

(52) U.S. Cl.
CPC ..... *A47C 1/024* (2013.01); *A47C 3/026* (2013.01)

(58) Field of Classification Search
CPC ..... A47C 1/024; A47C 1/022; A47C 1/02; A47C 3/026; A47C 3/02
USPC ..... 297/329, 325, 313, 311
See application file for complete search history.

(56) References Cited

U.S. PATENT DOCUMENTS 4,502,729 A * 3/1985 Locher ..... A47C 1/03255 297/300.3
4,773,706 A * 9/1988 Hinrichs ..... A47C 1/03255 297/300.5
5,069,496 A * 12/1991 Kunh ..... A47C 1/0246 267/158
5,195,801 A 3/1993 Franck et al.
5,499,861 A 3/1996 Locher
6,250,715 B1 * 6/2001 Caruso ..... A47C 1/03 297/300.2
6,863,346 B2 * 3/2005 Zund ..... A47C 1/023 297/322
7,695,067 B2 * 4/2010 Goetz ..... A47C 7/46 297/284.1
9,510,684 B2 * 12/2016 Schmitz ..... A47C 1/03255
9,706,845 B2 * 7/2017 Battey ..... A47C 1/023
9,833,075 B2 * 12/2017 Unwalla ..... A47C 1/03294
2002/0190553 A1 * 12/2002 Koepke ..... A47C 1/03255 297/300.2

(Continued)

FOREIGN PATENT DOCUMENTS

EP 2 110 050 A1 10/2009

OTHER PUBLICATIONS

Extended European Search Report dated Jun. 13, 2019 received in European Application No. 19 16 0349.7.

*Primary Examiner* — Mark R Wendell
(74) *Attorney, Agent, or Firm* — Mark M. Friedman

(57) ABSTRACT

A chair in which a synchronized mechanism, fixed on a telescopic post of a base, supports and renders interdependent rigid elements and which, define respectively the backrest and the seat of the chair and are mutually hinged at a first point, i.e. along a horizontal axis perpendicular to the longitudinal centerline plane of the seating space, which is entirely defined by a single curved line obtained by joining the rigid elements and which are adapted for this purpose.

7 Claims, 3 Drawing Sheets

(56) References Cited

U.S. PATENT DOCUMENTS

| | | | | |
|---|---|---|---|---|
| 2007/0278834 | A1* | 12/2007 | Kielland | A47B 23/04 297/170 |
| 2007/0290537 | A1* | 12/2007 | Lin | A47C 1/03238 297/300.2 |
| 2008/0100121 | A1* | 5/2008 | Serber | A47C 1/023 297/452.1 |
| 2016/0360887 | A1* | 12/2016 | Davis | A47C 1/03255 |
| 2019/0231077 | A1* | 8/2019 | Park | A47C 7/52 |

* cited by examiner

OFFICE CHAIR WITH SYNCHRONOUSLY MOVABLE BACKREST AND SEAT

The present invention relates to an office chair with synchronously movable backrest and seat.

It is always desirable that an office chair, in addition to being rotatable and height-adjustable, can also be capable of adapting, automatically and ergonomically, to the various different positions assumed by the user during the various phases of work: intense, normal and relaxed.

For this to happen, it is necessary first of all that the backrest and the seat of a chair incline simultaneously but describing different angular rotations.

To this end, operators in the sector have for some time availed of a specially-designed synchronized mechanism, available on the market in the same way as castor wheels and other accessories.

Such mechanism is placed on the telescopic post of the base, with or without wheels, in order to support the backrest and the seat and make them interdependent so that their movements, simultaneous but different, are mutually linked on the basis of the specific connection of the synchronized mechanism used to connect them.

Unfortunately most office chairs, with or without the above mentioned mechanism, are penalized by the fact that the backrest and the seat only partially support the movements of the body of the user, as they are not capable of exactly reproducing the fulcrums of the human body.

This is demonstrated by the fact that, when varying the configuration of the chair, the user perceives the unpleasant sensation of being not properly and constantly supported during the full travel of the mechanism, and feels that the back and the lumbar region enjoy proper support only when the configuration of the backrest is proximate to the vertical.

This can be ascribed especially to the fact that the seat and the backrest, which are both connected to the same synchronized mechanism but not to each other, are designed to move further apart from each other during the transition of the backrest from the erect configuration to an increasingly reclined one.

It should be noted that, to date, the only office chairs that have the seat and the backrest directly connected to each other are monocoque chairs which, as such, do not allow the use of the above mentioned synchronized mechanism, since it is not conceivable that two parts, rigidly connected to each other, could be moved in a mutually different manner.

The aim of the present invention is to devise an office chair that has a backrest and a seat which, by moving synchronously, best support the movements of the body of the user.

Within this aim, an object of the present invention is to devise an office chair that provides a backrest and a seat that are linked by a synchronized mechanism and are shaped and connected to each other in an unusual manner.

This aim and this object and others that will become better apparent hereinafter are achieved by a chair as defined in claim 1.

Further characteristics and advantages of the chair according to the invention will be more evident by the description of a preferred embodiment of the chair, illustrated by way of example in the following drawings, wherein.

Figure 1:
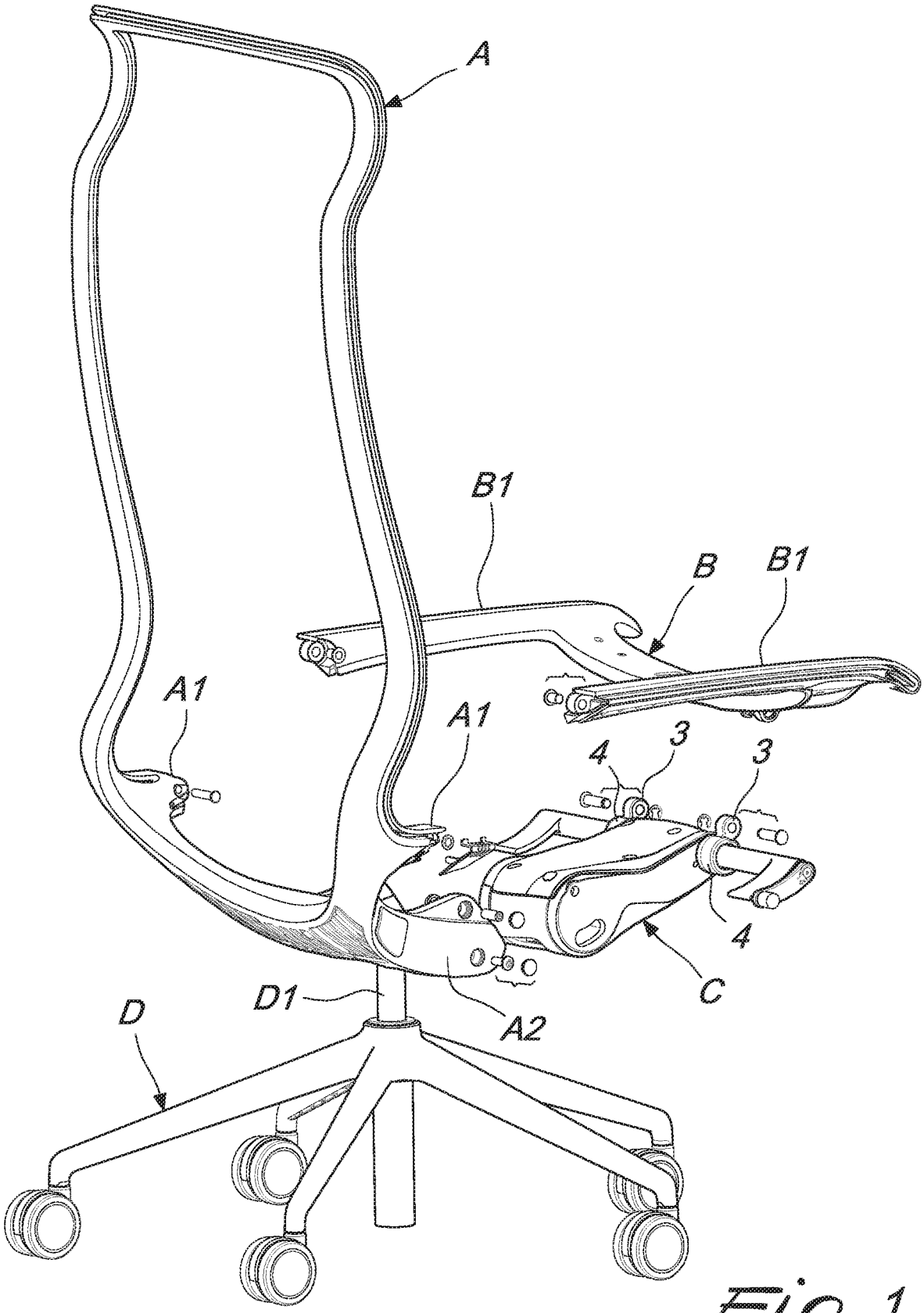
FIG. 1 is a perspective exploded view of a chair according to an embodiment of the present invention.
Figure 2:
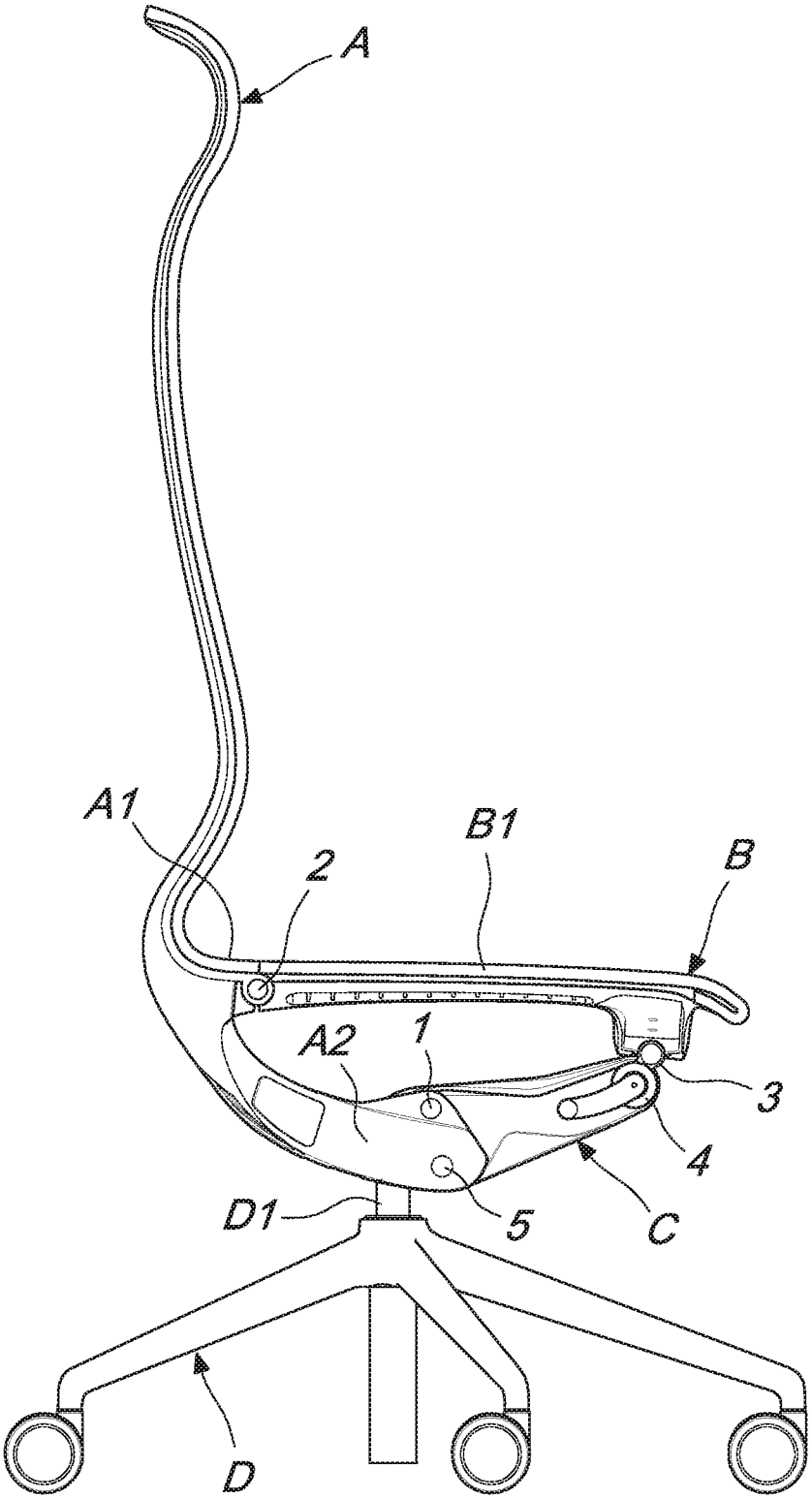
FIGS. 2 and 3 are side views of the same side of the assembled chair of the invention, in two limit configurations of its use.
Figure 3:
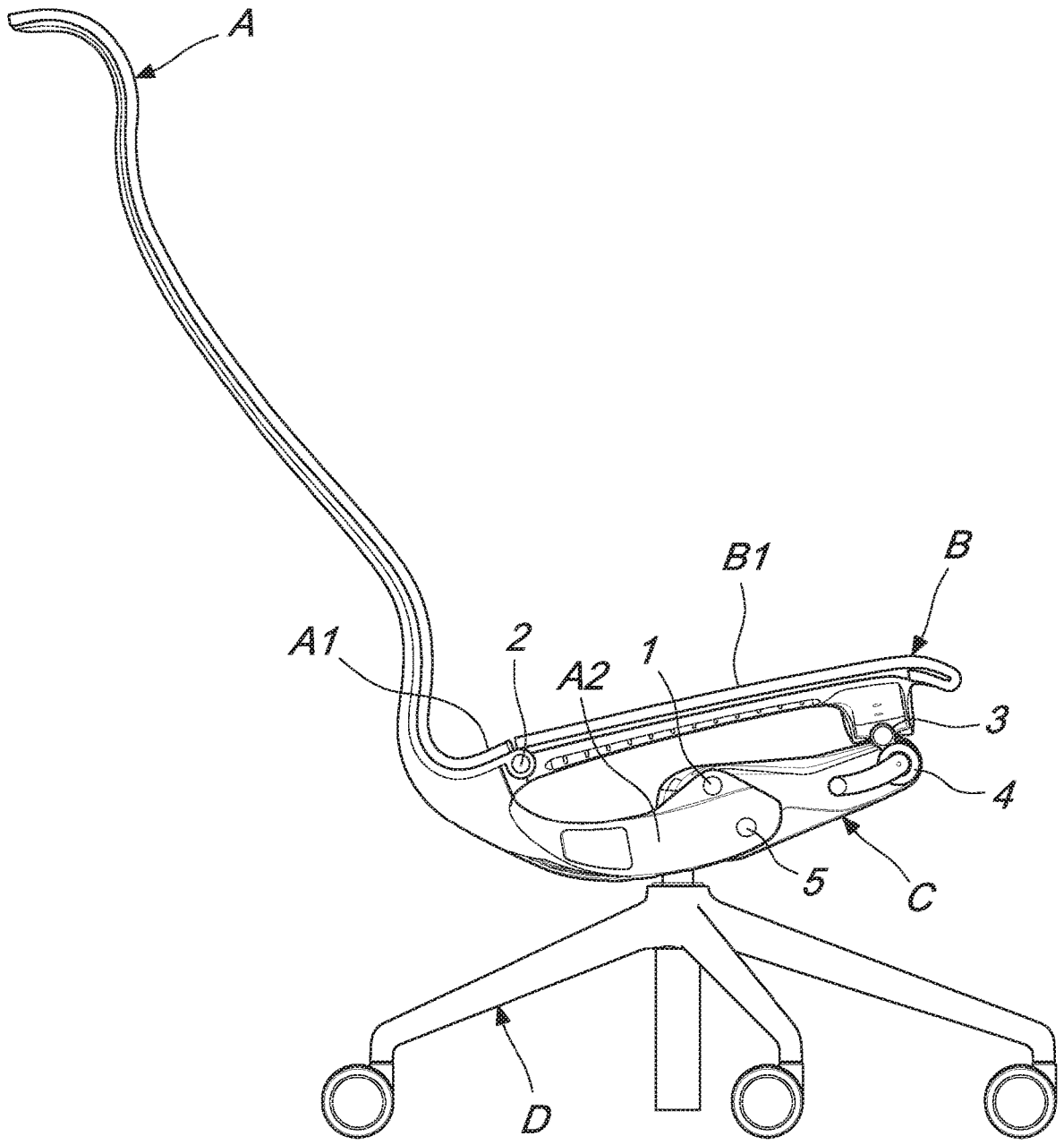

With reference to the figures it is possible to see that the principal characteristic of the invention consists of having the seat and the backrest stably and directly connected to each other, notwithstanding the different and linked movement of the two elements in the passage of the chair from one limit configuration to the other, i.e. from the configuration in FIG. 2 to the configuration in FIG. 3 and viceversa.

In fact, the seating space of the chair according to the invention is entirely defined by a single curved line obtained by joining rigid elements A and B which define respectively the backrest and the seat of the chair and are mutually hinged at a first point 2, i.e. along a horizontal axis perpendicular to the longitudinal centerline plane of the seating space.

In any case the invention consists of an adapted hinging, adjacent to an overlying flexible covering element in order to contain the stretching thereof when reclining the backrest.

In fact the covering element, which consists of a net, a sheet or other adapted material and is optionally padded, is in any case fixed to the curved line that defines and delimits the seating space, extending from the backrest A to the seat B without discontinuities.

As previously mentioned, the chair according to the present invention, like other conventional chairs, is provided with a synchronized mechanism C which, mounted on a telescopic post D1 of a base D, supports the rigid structure A of the backrest and the rigid structure B of the seat while also rendering their different and linked movements interdependent.

The rigid element or structure A, which acts as the backrest in a region above two minor-symmetrical portions A1 which protrude toward the rigid structure B that defines the seat to be hinged at the first point or hinge 2, continues under the above mentioned seat, which comes around from the rear, in order to straddle the mechanism C with two mirror-symmetrical portions A2 that are hinged horizontally at a rotatable joint 1 and contrasted elastically at a second point 5 by a system of springs present inside the mechanism for springing the backrest.

The rigid element or structure B that defines the seat, which is coupled in a front region to the underlying mechanism C by two bushings 3 which are hinged in the seat and by two bushings 4 which are integral with the first bushings and are hinged to the sides of the mechanism, has two mirror-symmetrical arms B1 which protrude rearward in order to be hinged at the first point 2 to the portions A1 of the rigid structure A and thus complete the curved line of the seating space.

As a consequence, every movement of the backrest A produces a simultaneous but different movement of the seat B, both being connected, together with the synchronized mechanism C, by a pair of articulated quadrilaterals that are mutually mirror-symmetrical and are defined by the horizontal hinging axes that pass through the points respectively defined by a pin 1 of the mechanism C, the first point 2, the bushings 3 and the bushings 4.

In fact, the rearward rotation of the backrest A about the pin point 1 of the mechanism C determines the entrainment of the seat B which, pivoted at the first point or hinge 2, by translating rearward forces the bushing 3, which is pivoted in the seat, to follow it, thus rotating the bushing 4, which is integral with the bushing 3 and is pivoted in the synchronized mechanism C.

While all this goes on, the rearward rotation of the backrest A and the movements that depend on this are contrasted at the second point 5 by the system of springs with which the synchronized mechanism C is provided in order to automatically support the movements of the body of the user, moreover guaranteeing the user, by virtue of the constant connection of the seat to the backrest, the broadest possible resting surface, which is essential in order to prevent areas of excessive pressure from blocking and reducing the flow of blood and causing muscle pains.

The armrests, if any, howsoever shaped, will be fixed to the rigid structure of the backrest A, it being necessary that they accompany any variation in trim thereof with respect to the seat B.

The disclosures in Italian Utility Model Application No. 202018000002761 from which this application claims priority are incorporated herein by reference.

What is claimed is:

1. An office chair comprising:

a base (D) having a telescopic post (D1);

a backrest (A) and a seat (B), which are rigid elements and are connected by a hinge (2) along a horizontal axis;

a synchronized mechanism (C), which is fixed on the telescopic post (D1) of said base (D) and supports said backrest (A) and said seat (B), which are rendered interdependent by said synchronized mechanism (C) so that the backrest (A) and the seat (B) of said chair incline simultaneously describing different angular rotations around said horizontal axis;

a flexible covering element connected to the backrest (A) and the seat (B) of said chair;

wherein the backrest (A) and the seat (B) of said chair entirely define the seating space of the chair by a single curved line; said hinge completing the curved line of the seating space;

wherein said flexible covering element are fixed to the backrest (A) and the seat (B) of said chair is fixed along to their curved line that defines and delimits the seating space, and extends from the backrest (A) to the seat (B) without discontinuities;

wherein said single curved line passes over the hinge (2) so that said hinge (2) is adjacent to said overlying flexible covering element in order to contain the stretching thereof when reclining the backrest (A).

2. The office chair with synchronously movable backrest and seat according to claim 1, wherein two mirror-symmetrical portions (A1) protrude forward, in a front region, from the rigid element that defines the backrest (A), which is pivoted on a rotatable joint (1) in the synchronized mechanism (C) and elastically countered at a point (5), and said two mirror-symmetrical portions (A1) are contoured and adapted for hinging by way of the hinge (2) of the rigid element (B) that defines the seat.

3. The office chair with synchronously movable backrest and seat according to claim 1, wherein the rigid element (B) that defines the seat, which is coupled in a front region to the underlying synchronized mechanism (C) by two first bushings (3) which are hinged in the rigid element (B) that defines the seat and by two second bushings (4) which are integral with the first bushings and are hinged to the sides of the synchronized mechanism (C), has two mirror-symmetrical arms (B1) which protrude rearward, in a rear region, for a rotatable coupling thereof to the two mirror—symmetrical portions (A1) of the rigid structure (A) by way of the hinges (2), thus completing the curved line of the seating space.

4. The office chair with synchronously movable backrest and seat according to claim 3, wherein the backrest (A), the seat (B), and the synchronized mechanism (C) are connected to each other by a pair of articulated quadrilaterals that are mutually mirror—symmetrical and are defined by the horizontal hinging axes of the rotatable joint (1), of the hinge (2), of the two first bushings (3) and of the two second bushings (4) so that a rearward rotation of the backrest (A) about a pin (1) of the mechanism (C) determines the entrainment of the seat (B) which, pivoted at a first point (2), by translating rearward forces the two first bushings (3), which is pivoted in the seat, to follow it, thus rotating the two second bushings (4), which are integral with the two first bushings (3) and are pivoted in the synchronized mechanism (C).

5. The office chair with synchronously movable backrest and seat according to claim 1, wherein the single flexible element is made from a net material.

6. The office chair with synchronously movable backrest and seat according to claim 1, wherein the single flexible element is made from a fabric material.

7. The office chair with synchronously movable backrest and seat according to claim 1, wherein the single flexible element is padded.

* * * * *